US005410284A

United States Patent [19]

Jachowski

[11] Patent Number: 5,410,284

[45] Date of Patent: Apr. 25, 1995

[54] FOLDED MULTIPLE BANDPASS FILTER WITH VARIOUS COUPLINGS

[75] Inventor: Douglas R. Jachowski, Redwood City, Calif.

[73] Assignee: Allen Telecom Group, Inc.

[21] Appl. No.: 987,648

[22] Filed: Dec. 9, 1992

[51] Int. Cl.[6] ..... H01P 1/20; H01P 1/205

[52] U.S. Cl. ..... 333/202; 333/203

[58] Field of Search ..... 333/202, 203, 208–212, 333/134, 135

[56] References Cited

U.S. PATENT DOCUMENTS

| | | | |
|---|---|---|---|
| 3,737,816 | 6/1973 | Honicke | 333/212 |
| 4,020,428 | 4/1977 | Friend et al. | 333/203 |
| 4,216,448 | 8/1980 | Kasuga et al. | 333/203 |
| 4,284,966 | 8/1981 | Wanat | 333/202 |
| 4,821,006 | 4/1989 | Ishikawa et al. | 333/202 |
| 4,937,533 | 6/1990 | Livingston | 333/203 X |
| 5,065,119 | 11/1991 | Jachowski | 333/202 |
| 5,083,102 | 1/1992 | Zaki | 333/212 |
| 5,153,541 | 10/1992 | Johnson et al. | 333/203 |

FOREIGN PATENT DOCUMENTS

| | | | |
|---|---|---|---|
| 0101369 | 2/1984 | European Pat. Off. | 333/212 |
| 0097404 | 5/1987 | Japan | 333/202 |

OTHER PUBLICATIONS

"Multi-Pass Band Filters by Synthesis", J. E. Colin, Societe Anonyme De Telecommunications, 1973.

"Approximation Theory for Filter-Networks", Hitoshi Watanabe, IRE Transactions on Circuit Theory, Sep. 1961, pp. 341–356.

"Effective Loss Design of Filters with Two Pass Bands", J. E. Colin, Circuit Theory and Design, Proceedings of the 1978 European Conference on Circuit Theory and Design, Section C8, pp. 617–621.

"Tunable, Temperature-Compensated Dielectric Resonators and Filters", Seng-Woon Chen, Kawthar A. Zaki, and Russell G. West, IEEE Transactions on Microwave Theory and Techniquest, vol. 38, No. 8, Aug. 1990, pp. 1046–1051.

"Filters with Single Transmission Zeros at Real or Imaginary Frequencies", Ralph Levy, IEEE Transactions on Microwave Theory and Techniques, vol. MTT-24, No. 4, Apr. 1976, pp. 172–181.

"Alignment and Adjustment of Synchronously Tuned Multiple-Resonant-Circuit Filters", Milton Dishal, Proceedings of the I.R.E., Nov., pp. 1448–1455, 1951.

"Synthesis of Combine and Capacitively Loaded Interdigital Bandpass Filters of Arbitrary Bandwidth", Robert J. Wenzel, IEE Transactions on Microwave Theory and Techniquest, vol. MTT-19, No. 8, Aug. 1971.

"Classes of Bandpass Filters Having an Arbitrary Wide Stopband and Design Tables for One Such Class", J. H. Kotzé, 1990 IEEE MTT-S Digest, pp. 123–126.

"Classes of Sub-Miniature Microwave Printed Circuit Filters with Arbitrary Passband and Stopband Widths", Brian J. Minnis, IEEF Transactions on Microwave Theory and Techniquest, vol. 30, No. 11, Nov. 1982.

"Exact Design of Wideband Equal-Ripple Bandpass Filters with Non-Adjacent Resonator Couplings", R. J. Wenzel, IEEE MTT-S International Microwave Symposium 1976, pp. 125–127.

*Primary Examiner*—Seungsook Ham

*Attorney, Agent, or Firm*—Dressler, Goldsmith, Shore & Milnamow, Ltd.

[57] ABSTRACT

A poly-band filter includes a folded metal housing which defines an interior region partitioned by a divider. First and second pluralities of resonators are provided in the housing. Alternately increasing and decreasing degrees of coupling are provided between adjacent resonators in the housing. Slot coupling is provided between first and second non-adjacent resonators displaced from input/output connectors for the filter.

31 Claims, 3 Drawing Sheets

Fig. 1
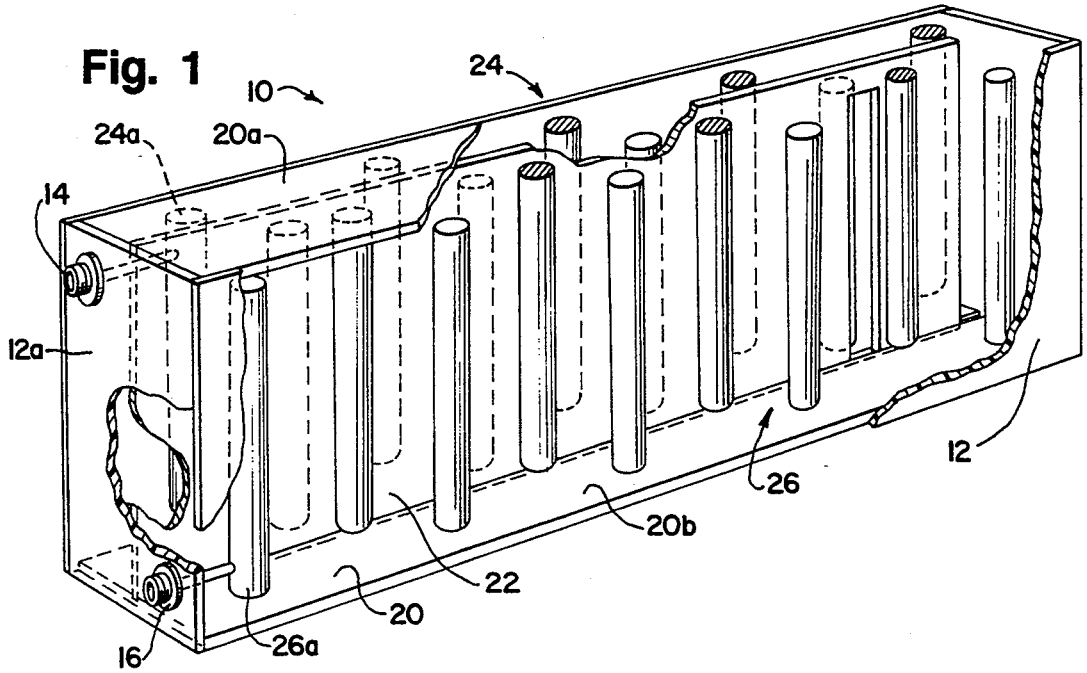
Fig. 2
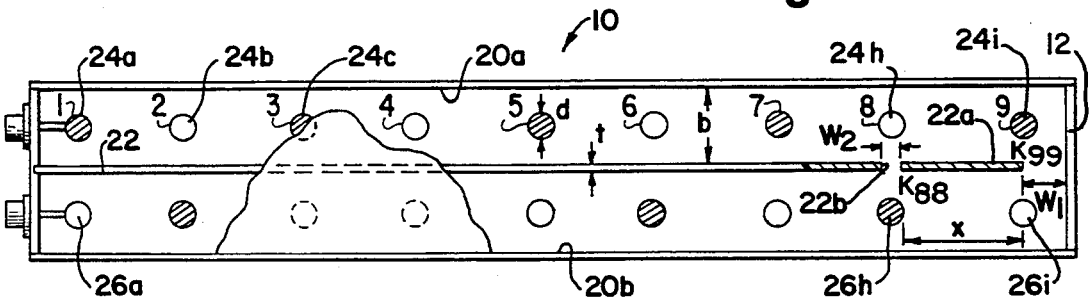
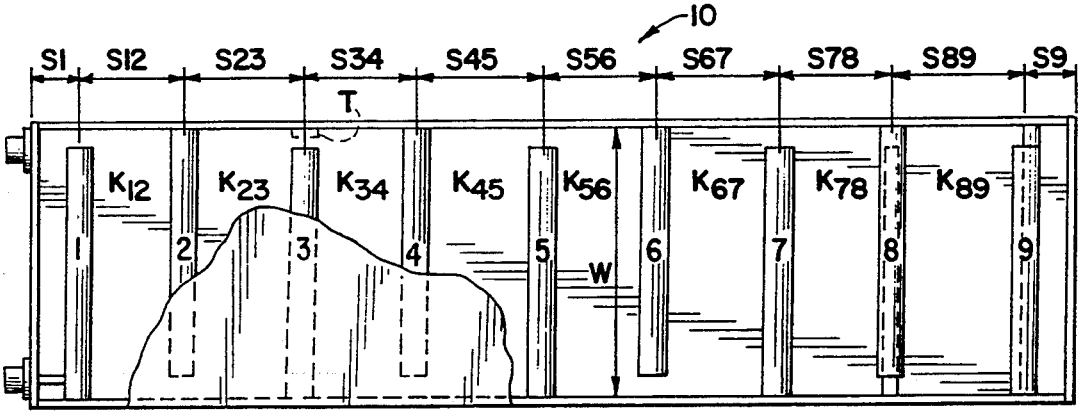
Fig. 3

FOLDED MULTIPLE BANDPASS FILTER WITH VARIOUS COUPLINGS

FIELD OF THE INVENTION

The invention pertains to two port filters having multiple pass bands which are separated by one or more intervening stop bands. More particularly, the invention pertains to such filters where the pass bands are relatively narrow, and are located relatively close to one another on a linear frequency scale.

BACKGROUND OF THE INVENTION

It has been known to use separate electrically connected filters where several pass bands are required. For example, in cellular radio telephone systems, there is a need to be able to discriminate signals in two relatively narrow pass bands. These pass bands are separated by an intervening stop band.

The use of two parallel, individual, single pass band filters to provide a dual pass band function suffers from a need to provide enough physical space for two separate filters. Further, there is a phasing requirement which must be met where two separate single pass band filters are coupled in parallel.

Another disadvantage of using two separate filters is that the pass band insertion losses will be greater than desired. Finally, two different sets of filter elements are required for two separate filters, one set resonant in one pass band, the other set resonant in the other pass band.

Thus, there continues to be a need for a poly-band filter structure which provides a multiple pass band function implemented in a single filter. Preferably, such a filter will be smaller physically than two individual single pass band filters which have been connected in parallel. Further, such a filter will preferably have a lower insertion loss and better selectivity than the two separate filter embodiment. Finally, such a filter might have only one set of filter elements, which all resonate at the same frequency.

SUMMARY OF THE INVENTION

A poly-band two port filter in accordance with the invention includes an elongated metal housing which defines an interior region. The housing carries a radio frequency input port and a radio frequency output port.

A plurality of resonators is carried within the region of the housing. The resonators are spaced from one another so as to achieve increasing and decreasing coupling between adjacent resonators.

A predetermined center stop frequency is located between the two pass bands.

Improved performance can be achieved by providing coupling between at least two selected, non-adjacent, resonators.

The housing can be folded as to have a U-shaped cross-section. With such a housing, coupling can be readily effected between two of the non-adjacent resonators by using a slot, or a probe, or an iris. The shape or type of coupling mechanism will determine the capacitive or inductive characteristic of the coupling, and so will determine whether a real or complex frequency attenuation pole is contributed to the filter transfer function.

In one aspect of the invention, the plurality can include an even number of resonators wherein each resonator is resonant at the middle stop band center frequency. In another aspect of the invention, the plurality can include an odd number of resonators wherein each resonator is resonant at the middle pass band center frequency.

In yet another aspect of the invention, some of the resonators are arranged so as to have an interdigital relationship with respect to one another. Alternately, the resonators can be arranged in a combline fashion. Further, at least some of the resonators are substantially identical to one another and are resonant at the same frequency.

In yet another aspect of the invention, a dual-band filter with two pass bands, each having a width on the order of 4 MHZ with stop bands located above, between, and below the pass bands is provided. This filter includes a folded conducting housing which supports an even number of interdigitally oriented resonators therein. Each resonator is adjusted to be resonant at the intervening stop band center frequency.

In yet another aspect of the invention, the resonators can be implemented as direct coupled dielectric resonators. Further, in accordance with the invention, the resonators can exhibit an increased and decreased degree of coupling with respect to adjacent resonators.

In yet another aspect of the invention, the resonators can be implemented as direct coupled and/or iris coupled dual mode dielectric resonators or cavities. In accordance with the present invention, the individual modes of the resonators can exhibit an increased and decreased degree of coupling with respect to adjacent resonant modes. Further, dual-mode technology facilitates implementing non-adjacent or non-main path coupling to improve the filter's attenuation or group delay response.

These and other aspects and attributes of the present invention will be discussed with reference to the following drawings and accompanying specification.

BRIEF DESCRIPTION OF THE DRAWINGS

FIG. 1 is a perspective view, partly broken away, of an interdigital embodiment of a filter in accordance with the present invention;

FIG. 2 is a top plan view, partly broken away, of the filter of FIG. 1;

FIG. 3 is an elevational view, partly broken away, of the filter of FIG. 1;

DETAILED DESCRIPTION OF THE PREFERRED EMBODIMENT

Figure 4:
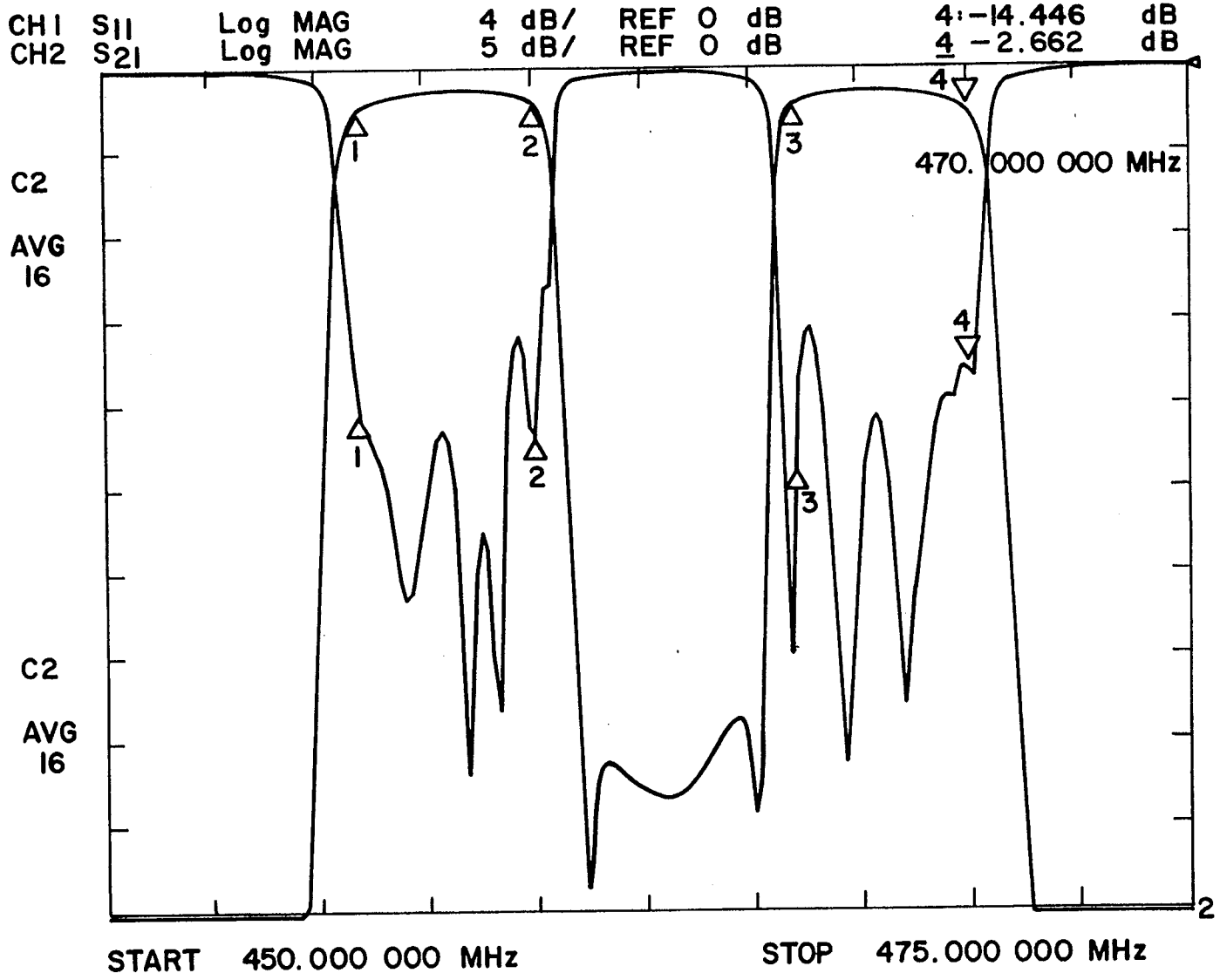
FIG. 4 is a graph illustrating measured performance characters of the filter of FIG. 1.

While this invention is susceptible of embodiment in many different forms, there is shown in the drawing, and will be described herein in detail, specific embodiments thereof with the understanding that the present disclosure is to be considered as an exemplification of the principles of the invention and is not intended to limit the invention to the specific embodiments illustrated.

A dual band pass filter 10, illustrated in FIGS. 1 through 3. The filter 10 exhibits two pass bands, one from 456 MHZ to 460 MHZ and the other from 466 MHZ to 470 MHZ. The filter 10 has a center stop frequency on the order of 463 MHZ. The filter 10 includes an elongated metal housing 12.

The housing 12 includes a front panel 12*a* and a rear panel 12*b*. A coaxial radio frequency input connector 14 and a coaxial radio frequency output connector 16 are carried on the panel 12*a*. The housing 12 defines an interior region 20. The region 20 is elongated and is divided into two substantially equal parts, 20*a* and 20*b*, by a metal partition 22. A first plurality of resonators 24 and a second plurality of resonators 26 are located in each of the sub-regions 20*a* and 20*b*.

A first resonator 24*a* is coupled to the RF input connector 14 in any conventional fashion (such as a tap wire, probe, loop, or capacitance). A resonator 26*a* is coupled to the output RF connector 16 also in any conventional fashion. The members of the pluralities 24 and 26 are all cylindrical rod resonators having a length on the order of a quarter wavelength of the center stop frequency of the filter 10, such that they resonate at the center stop frequency when capacitively loaded by the housing.

The members of the pluralities 24, 26 are arranged in an interdigital fashion. Alternate types of resonators or arrangements are possible as discussed subsequently.

Each of the pluralities 24, 26 contains the same number of resonators. Alternate numbers of resonators, such as odd, every, or asymmetrical, are possible without departing from the spirit and scope of the present invention.

The members of each plurality are spaced apart from one another by varying amounts so as to create alternately increasing and decreasing amounts of coupling between adjacent members of a plurality, such as resonators 24*a*, 24*b* and 24*c*. The alternately varying spacings of the members of the two pluralities are substantially identical.

Table 1 sets forth an exemplary set of alternately increasing and decreasing spacings in inches, as well as other mechanical dimensions, used in connection with the filter 10 to achieve the pass bands and center stop frequency noted previously. Table 2 discloses the alternating inter-resonator coupling values.

TABLE 1

| Resonator Lengths | Filter Dimensions |
|---|---|
| L1 = 5.951" | S1 = 0.9375 |
| L2 = 5.895" | S2 = 2.557 |
| L3 = 5.895" | S23 = 2.912 |
| L4 = 5.895" | S34 = 2.693 |
| L5 = 5.895" | S45 = 3.003 |
| L6 = 5.895" | S56 = 2.684 |
| L7 = 5.895" | S67 = 3.048 |
| L8 = 5.965" | S78 = 2.683 |
| L9 = 5.965" | S89 = 3.219 |
| | S9 = 0.9375 |
| w = 6.400" | |
| d = 0.625" | |
| b = 1.875" | |
| t = 0.1875" | |
| $w_1$ = 1.022" | |
| $w_2$ = 0.555" | |
| x = 2.857" | |

TABLE 2

| Coupling Values |
|---|
| $K_{12}$ = 0.196529 |

TABLE 2-continued

| Coupling Values |
|---|
| $K_{23}$ = 0.0112073 |
| $K_{34}$ = 0.0161890 |
| $K_{45}$ = 0.0096308 |
| $K_{56}$ = 0.0164477 |
| $K_{67}$ = 0.0089220 |
| $K_{78}$ = 0.026635915 |
| $K_{89}$ = 0.006639273 |
| $K_{88}$ = 0.005622130 |
| $K_{99}$ = 0.011308895 |

As illustrated in Table 1, the coupling between adjacent resonators in addition to alternately increasing and decreasing generally becomes progressively smaller towards the center of the filter 10.

The divider 22 extends from the front panel 12*a* through the region 20 but terminates before it reaches the rear panel 12*b*. The space between an end 22*a* of the divider 22 and the end panel 12*b* is provided to enable resonator 24*i* to couple to adjacent resonator 26*i*.

In addition, inexpensive slot coupling is provided between two non-adjacent resonators, such as resonators 24*h* and 26*h* by a slot 22*b* in the divider 22. The slot 22*b* has been located so as to provide coupling between two non-adjacent resonators which are displaced as far as possible from the input/output ports and the connectors 14 and 16. Since the housing 12 has been folded in to a U-shaped cross section, it becomes very easy to provide slot coupling between two non-adjacent resonators as illustrated in FIGS. 1 through 3.

Alternate types of coupling could be used. For example, iris, probe, or capacitive coupling also come within the spirit and scope of the present invention.

FIG. 4 illustrates graphs of the input return loss, channel 1 and the gain of the filter, channel 2 over a frequency range of 450–475 MHZ for the filter 10. As illustrated in FIG. 4, the filter 10 exhibits 4 MHZ wide pass bands having on the order of 2.7 db loss with more than 33 db attenuation exhibited elsewhere.

The additional coupling provided by the slot 22*b*, produces two real frequency transmission zeros in the two pass bands. Two sharp attenuation peaks and improved selectivity between the pass bands result from the slot 22*b*.

The filter 10 exhibits lower band edge insertion loss especially at the interior band edges than two individual single band pass filters can be expected to exhibit. Further, the filter 10 is physically smaller than two corresponding separate filter. The resonators 24, 26 and the slot 22*b* are all relatively inexpensive components which reduces the cost of the filter 10. In addition, fewer connectors are needed and no phasing cable is needed for the filter 10.

Figure 5:
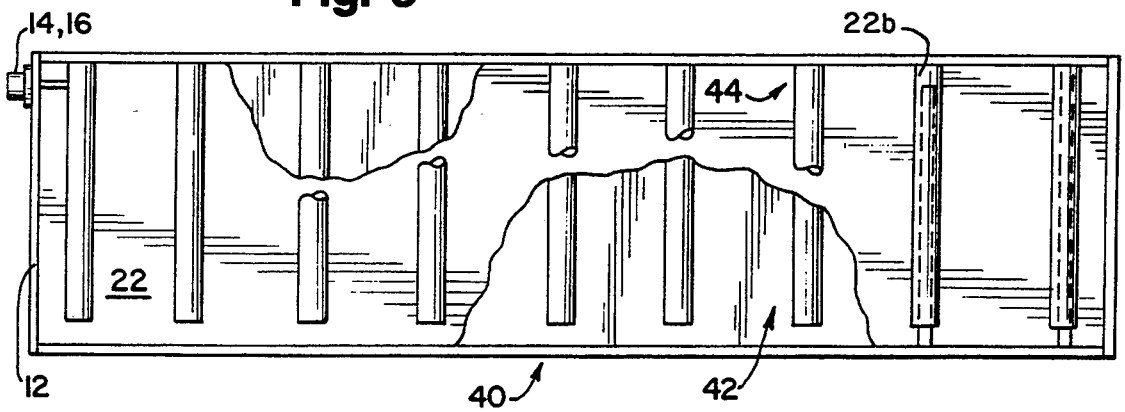
FIG. 5 is an elevational view, partly broken away, of an alternate, combline embodiment of a filter in accordance with the present invention.

FIG. 5 illustrates, as an alternate embodiment, a filter 40. In the filter 40, the two pluralities of resonators 42 and 44 are arranged in combline fashion. Elements of the filter 40 that are the same as in the filter 10 have been assigned the same identification numerals as in FIGS. 1 through 3. The members of the pluralities 42, 44 are spaced apart from one another with increasing and deceasing degrees of coupling as discussed previously.

Figure 6:
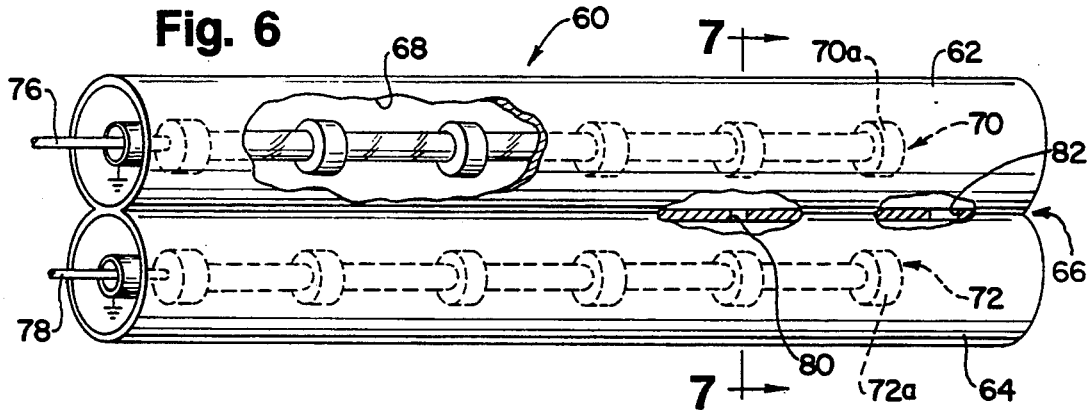
FIG. 6 is an elevational view party, broken away, of an alternate, coupled dielectric resonator embodiment of a filter in accordance with the present invention.
Figure 7:
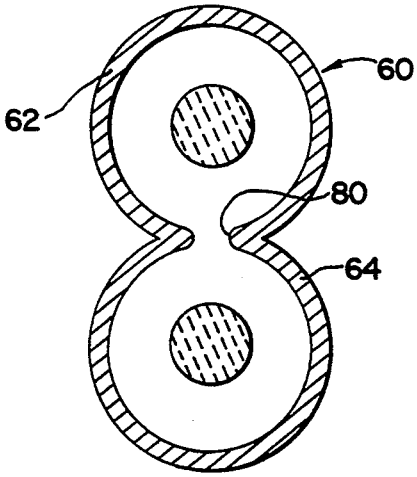
FIG. 7 is a sectional view taken along plane 7—7 of FIG. 6.

FIG. 6 illustrates yet another embodiment of a polyband filter 60 in accordance with the present invention. The filter 60 includes first and second generally cylindrical housings 62 and 64 which are coupled together in a region 66, which forms a conductive divider analogous to the divider 22. Each of the housings defines an interior region, such as the region 68.

In each of the interior regions a plurality of ceramic resonators, such as the pluralities 70 and 72, are located. The resonators are spaced apart from one another and supported in any conventional fashion.

The filter 60 includes input and output connectors 76 and 78. Slot coupling is provided between two non-adjacent resonators by a slot 80 formed in the divider 66. An open end region 82 couples a resonator 70*a* to a resonator 72*a*.

The ceramic resonators can be spaced apart with alternatingly increasing and decreasing degrees of coupling analogous to that of Table 1 discussed previously.

Each of the resonators in the plurality of resonators of the filter of FIG. 1 can include a frequency tuning element, illustrated in phantom as element T, in FIG. 3.

In accordance with another aspect of the invention, a triple-band, bandpass filter exhibiting at least three pass bands, upper, middle and lower, and four stop bands. A metal enclosure defines an interior region. The enclosure carries a radio frequency signal input port and a radio frequency signal output port.

A plurality of resonators is contained within the housing with the resonators spaced from one another wherein at least some of the resonators have substantially the same resonant frequency as the center frequency of the middle pass band, and with none of the other resonators having a resonant frequency within either the lower or upper pass bands.

Means are provided for coupling at least two selected resonators to more than two other selected resonators, thereby improving the frequency response characteristic of the filter. At least some resonators are coupled to adjacent ones thereof with alternating increasing and decreasing degrees of coupling.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

What is claimed is:

1. A multiple pass band, two port filter, where the pass bands are not harmonics of each other, having at least one stop band located between first and second pass bands, the filter comprising:

an elongated conductive housing defining an interior region, said housing carrying a radio frequency signal input port and a radio frequency signal output port;

a plurality of resonators carried within said region of said housing with at least some of said resonators spaced from one another so as to achieve consecutively alternating increasing and decreasing electromagnetic coupling values; and means for providing coupling between at least two of said resonators, so that said two resonators each have three or more couplings wherein said resonators and said coupling means interact to provide a filter characteristic between said ports and wherein said filter characteristic includes first and second spaced apart pass bands.

2. A filter as in claim 1 wherein at least some of said resonators are substantially identical to one another and resonate at substantially the same frequency, and none of the resonators are individually resonant in either of the pass bands.

3. A filter as in claim 2, wherein at least some of said resonators are conductive and have a length, at one end of which they are grounded to the housing at the other end of which they are open and capacitively loaded.

4. A filter as in claim 3 wherein at least some of said resonators are arranged in interdigital relationship with respect to one another.

5. A filter as in claim 3 wherein at least some of said resonators are arranged in a combline relationship with respect to one another.

6. A filter as in claim 1 wherein said housing is folded to a U-shaped cross section, creating a first portion of said housing on one side of said U-shape and creating a second portion of said housing on the other side of said U-shape.

7. A filter as in claim 6 wherein at least one of said resonators, located in said first portion of said housing, is coupled to a selected one of said resonators located in said second, adjacent portion of said housing.

8. A filter as in claim 2 wherein said substantially identical resonators include a conductive cylindrical rod.

9. A dual band filter with two spaced-apart pass bands, which define an upper, middle, and lower stop band, with the middle stop band having a center frequency located therebetween, where the two pass bands are not harmonics of each other, the filter comprising:

a conductive enclosure;

an even number of resonators spaced within said enclosure, each electromagnetically coupled to its physically and electrically adjacent resonators, so as to achieve at least some consecutively alternating greater and lesser degrees of coupling, wherein at least some of said resonators are resonant at the middle stop band center frequency, and wherein none of said resonators are individually resonant in either of the two pass bands; and including at least one coupling device for coupling between at least one pair of selected non-adjacent resonators.

10. A filter as in claim 9 wherein said resonators are substantially identical to one another.

11. A filter as in claim 9 wherein said resonators are arranged interdigitally within said enclosure.

12. A filter as in claim 9 wherein said enclosure includes a plurality of substantially planar metal members.

13. A filter as in claim 9 which includes a conductive dividing wall within the enclosure, wherein said wall is electrically connected to the enclosure, which electrically isolates some of said resonators from other resonators, and wherein said coupling device includes at least one slot formed to couple said non-adjacent resonators.

14. A filter as in claim 9 wherein selected of said resonators are spaced apart from one another by predetermined varying distances.

15. A filter as in claim 9 wherein at least some of said resonators are dielectric resonators.

16. A filter as in claim 9 wherein at least some of said resonators are formed as substantially identical elongated conducting members.

17. A filter as in claim 16 wherein at least some of said conducting members are arranged interdigitally.

18. A filter as in claim 16 wherein at least some of said conducting members are arranged in a combline fashion.

19. A filter as in claim 9 wherein said resonators are divided into first and second groups with a conducting divider attached within said enclosure therebetween.

20. A filter as in claim 19 wherein at least said coupling device includes an opening in said divider between said first and said second groups of resonators.

21. A multiple band filter with a center stop frequency between at least two spaced apart pass bands, wherein each pass band is lower in frequency than the second harmonic of the other, the filter comprising:

a conductive housing defining an interior region with said region divided into first and second parts by a conductive member attached to said housing;

first and second ports coupled to said housing; and a plurality of substantially identical resonators carried within said housing with a first portion of resonators from said plurality carried in said first part and with a second portion of resonators from said plurality carried in said second part and wherein adjacent resonators in said first portion are coupled to one another with alternately larger and smaller degrees of coupling wherein a filter characteristic having at least two spaced apart pass bands is exhibited between said ports in response to said resonators interacting by said alternating degrees of coupling.

22. A filter as in claim 21 wherein each of said resonators of said plurality includes a frequency tuning element.

23. A filter as in claim 21 wherein adjacent resonators in said second portion are coupled to one another with alternately larger and smaller degrees of coupling.

24. A filter as in claim 21 wherein at least one selected resonator in said first part is coupled to at least one non-adjacent selected resonator in said second part.

25. A filter as in claim 24 including capacitive coupling between said selected, coupled resonators.

26. A filter as in claim 21 wherein said conductive member defines an opening therethrough for coupling a selected resonator in said first part to a selected resonator in said second part.

27. A filter as in claim 21 wherein said resonators are arranged in a combline configuration.

28. A triple-band, bandpass filter exhibiting at least three pass bands, upper, middle and lower, and four stop bands comprising:

a metal enclosure defining an interior region, said enclosure carrying a radio frequency signal input port and a radio frequency signal output port;

a plurality of resonators contained within said region of said housing with said resonators spaced from one another wherein at least some of the resonators have substantially the same resonant frequency as the center frequency of the middle pass band, and with none of the other resonators having a resonant frequency within either the lower or upper pass bands;

means for coupling at least two selected resonators to more than two other selected resonators, thereby improving the frequency response characteristic of the filter; and wherein at least some resonators are coupled to adjacent ones thereof with alternating increasing and decreasing degrees of coupling.

29. A poly-band, bandpass filter comprising:

a plurality of pass bands Wherein one is a middle pass band and a plurality of stop bands, where all of these pass bands are below any of the second harmonics thereof;

a plurality of resonators contained within said region of said housing with said resonators spaced from one another and with at least some of the resonators having substantially the same resonant frequency as the center frequency of the middle pass band, and with none of the other resonators having a resonant frequency within either the lower of upper pass bands;

means for coupling at least two selected resonators to more than two other selected resonators, thereby improving the frequency response characteristic of the filter; and wherein at least some resonators are coupled to adjacent ones thereof with alternating increasing and decreasing degrees of coupling.

30. A multiple pass band two port filter having at least one stop band positioned between first and second pass bands comprising:

a conductive enclosure which defines, at least in part, an interior region;

first and second ports carried by said enclosure;

a plurality of resonators carried within said region wherein some of said resonators are divided into first and second groups and wherein said first port is associated with said first group and said second port is associated with said second group such that members of said first group are not coupled with members of said second group and wherein said plurality includes two additional resonators, not in said groups wherein each of said two additional resonators is coupled to a respective one of said groups, to the other of said additional resonators, and wherein each of said additional resonators is coupled to yet another member of said plurality, not in either of said groups wherein as a result of increasing and decreasing coupling between said members of at least one of said groups, a multiple pass band characteristic is exhibited between said ports.

31. A filter as in claim 30 which includes a conductive member carried by said enclosure wherein said member extends substantially between said groups and wherein said member defines an aperature providing said coupling between said two resonators.

* * * * *